US006899529B2

(12) United States Patent
Ishikawa et al.

(10) Patent No.: US 6,899,529 B2
(45) Date of Patent: May 31, 2005

(54) CONNECTING STRUCTURE FOR VACUUM PUMP

(75) Inventors: Takaharu Ishikawa, Chiba (JP); Akira Yamauchi, Chiba (JP)

(73) Assignee: BOC Edwards Technologies Limited, Narashino (JP)

( * ) Notice: Subject to any disclaimer, the term of this patent is extended or adjusted under 35 U.S.C. 154(b) by 5 days.

(21) Appl. No.: 10/213,255

(22) Filed: Aug. 6, 2002

(65) Prior Publication Data

US 2003/0035737 A1 Feb. 20, 2003

(30) Foreign Application Priority Data

Aug. 8, 2001 (JP) ..... 2001-240093

(51) Int. Cl.[7] ..... F04B 39/12
(52) U.S. Cl. ..... 417/363; 417/423.4; 417/572
(58) Field of Search ..... 417/309, 305, 417/423.4, 423.14, 423.15, 353, 363, 313, 572, 365; 74/574; 415/90

(56) References Cited

U.S. PATENT DOCUMENTS 4,352,643 A * 10/1982 Iijima ..... 417/313
4,541,772 A * 9/1985 Becker ..... 415/90
4,946,345 A * 8/1990 Watanabe et al. ..... 415/90
5,145,812 A * 9/1992 Arai et al. ..... 501/97
6,090,879 A * 7/2000 Takuman et al. ..... 524/437
6,422,837 B1 * 7/2002 Komoriya ..... 417/423.4
6,575,713 B2 * 6/2003 Ohtachi et al. ..... 417/353

FOREIGN PATENT DOCUMENTS

| | | | |
|---|---|---|---|
| DE | 10001509 | | 7/2001 |
| EP | 1118774 | | 7/2001 |
| JP | 56-38598 | * | 4/1981 |
| JP | 2000-73986 | * | 3/2000 |

* cited by examiner

*Primary Examiner*—Michael Koczo, Jr.
(74) *Attorney, Agent, or Firm*—Adams & Wilks

(57) ABSTRACT

Provided is a connecting structure for a vacuum pump, which can block propagation of electrical noise, generated by a main body of the vacuum pump. Between both ends of a connection piping for connecting the vacuum pump to a vacuum chamber of an apparatus to be connected with and evacuated by the vacuum pump, there is interposedly provided an electrical insulating portion formed of an insulating material so as to provide electrical insulation therebetween. The electrical insulation portion may be provided to a connection piping member such as a damper (or a valve depending on the connection arrangement) for absorbing mechanical vibrations.

18 Claims, 6 Drawing Sheets

CONNECTING STRUCTURE FOR VACUUM PUMP

BACKGROUND OF THE INVENTION

1. Field of the Invention

The present invention relates to a connecting structure for connecting a vacuum pump. In particular, it relates to a connecting structure for a vacuum pump, which is capable of blocking propagation of electrical noise generated by a main body of the vacuum pump.

2. Description of the Related Art

A conventional connecting structure used for connecting a vacuum pump (hereinafter referred to as the "connecting structure for a vacuum pump) is shown in FIG. 6.

Referring to FIG. 6, when a vacuum pump 101 is connected through connection piping to a measuring apparatus such as an electron microscope which requires a vibration-free environment to operate, a damper 105 as a vibration absorbing member is interposedly disposed within the connection piping. Electron microscope etc. are provided in a vacuum chamber 103 being a measurement chamber. The vacuum pump 101 is suspended from the vacuum chamber 103 with the damper 105 so as to be connected thereto.

The damper 105 is constructed so that a bellows 105*a* is sandwiched between flanges 107 and 109 arranged on its both ends. The bellows 105*a* absorbs vibrations between a suction port of the vacuum pump 101 and the vacuum chamber 103.

The bellows 105*a* is formed of a stainless material in order to have a mechanical strength sufficient to protect itself in an event of the vacuum pump 101 being broken due to centrifugal force.

Connection between the damper 105 and the vacuum chamber 103 is provided by means of the flange 109 formed at the upper end of the damper 105 and a flange 113 of the vacuum chamber 103. Connection between the damper 105 and the vacuum pump 101 is provided by means of the flange 107 formed at the lower end of the damper 105 and a suction flange 111 of the vacuum pump 101.

In the thus constructed connecting structure for the vacuum pump 101, operating the vacuum pump 101 for suction and decompression purposes allows decompression of the vacuum chamber 103 to be effected from the suction port of the vacuum pump 101 through the connection piping. At this time, vibrations are generated by a main body of the vacuum pump 101 due to such factors as an unbalanced state of a rotor and cogging torque acting during a rotational drive. Such mechanical vibrations of the vacuum pump 101 are blocked out by the damper 105, whereby the vibrations do not reach the vacuum chamber 103 so that a vibration-free environment can be maintained.

However, in the above construction, the damper 105 which constitutes the above-described connection piping is formed of a material with high electrical conductivity such as a stainless material, including its portions of the both flanges 107 and 109. This may lead to a troublesome situation where electrical noise generated by electric equipment such as a motor disposed within the vacuum pump 101 propagates into an apparatus to be connected with the vacuum pump 101. In particular, in a case of a measuring apparatus, which requires for its operation an environment isolated of disturbances such as mechanical vibrations and electrical noise, even if it is effectively guarded against intrusion of disturbances from the outside, disturbances generated by an associated apparatus such as the vacuum pump 101 connected to the measuring apparatus may induce reduction in the measurement accuracy thereof.

SUMMARY OF THE INVENTION

The present invention has been devised in view of the above-described drawbacks of the conventional art. Therefore, an object of the present invention is to provide a connecting structure for a vacuum pump, which is capable of blocking propagation of electrical noise generated by a main body of the vacuum pump.

In order to attain the above object, according to the present invention, there is provided a connecting structure for a vacuum pump comprising: a vacuum pump; an apparatus to be evacuated by the vacuum pump; connection means for connecting the apparatus to be evacuated with the vacuum pump; and an electrical insulating portion which is interposedly provided within the connection means and formed of an electrical insulating material to provide electrical insulation.

The electrical insulating portion disposed interposedly within a connection piping serves to block out propagation of electrical noise generated by the vacuum pump. Therefore, an electrical insulating environment that is free from electrical influences exerted by the vacuum pump can be ensured even when the vacuum pump is connected to a measuring apparatus that is highly susceptible to the influence of electromagnetic waves.

Further, the present invention is also characterized in that the electrical insulating portion is formed using at least one material selected from resin, rubber, and ceramic.

Further, the present invention is characterized in that a protective cover corresponding to the vacuum pump is provided, around the outer periphery of the connection means.

Since the protective cover provides effective protection in an event of breakage of the vacuum pump, a greater degree of freedom is afforded in designing the electrical insulating portion.

Further, the present invention is characterized in that the electrical insulating portion is arranged in a connecting piping member such as a damper for absorbing mechanical vibrations and a valve for adjusting suction flow rate.

Since the electrical insulating portion is provided to the connecting piping member such as the damper and the valve, electrical insulating properties can be ensured by connecting the damper or the valve through piping, without the necessity of attaching a member dedicated for providing electrical insulation.

DETAILED DESCRIPTION OF THE PREFERRED EMBODIMENTS

Figure 1:
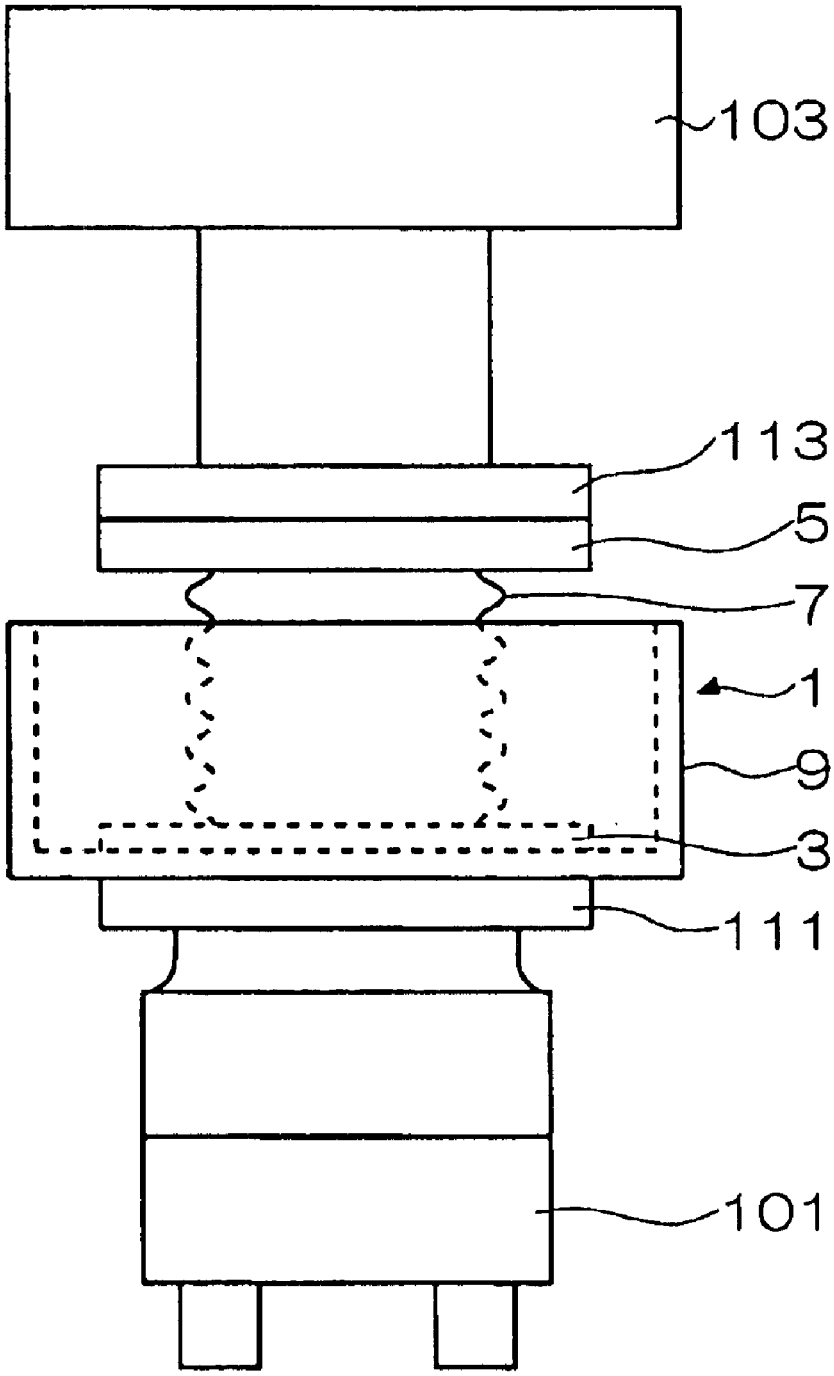
FIG. 1 is a side elevation view of a connecting structure for a vacuum pump in accordance with a first embodiment of the present invention.
Figure 6:
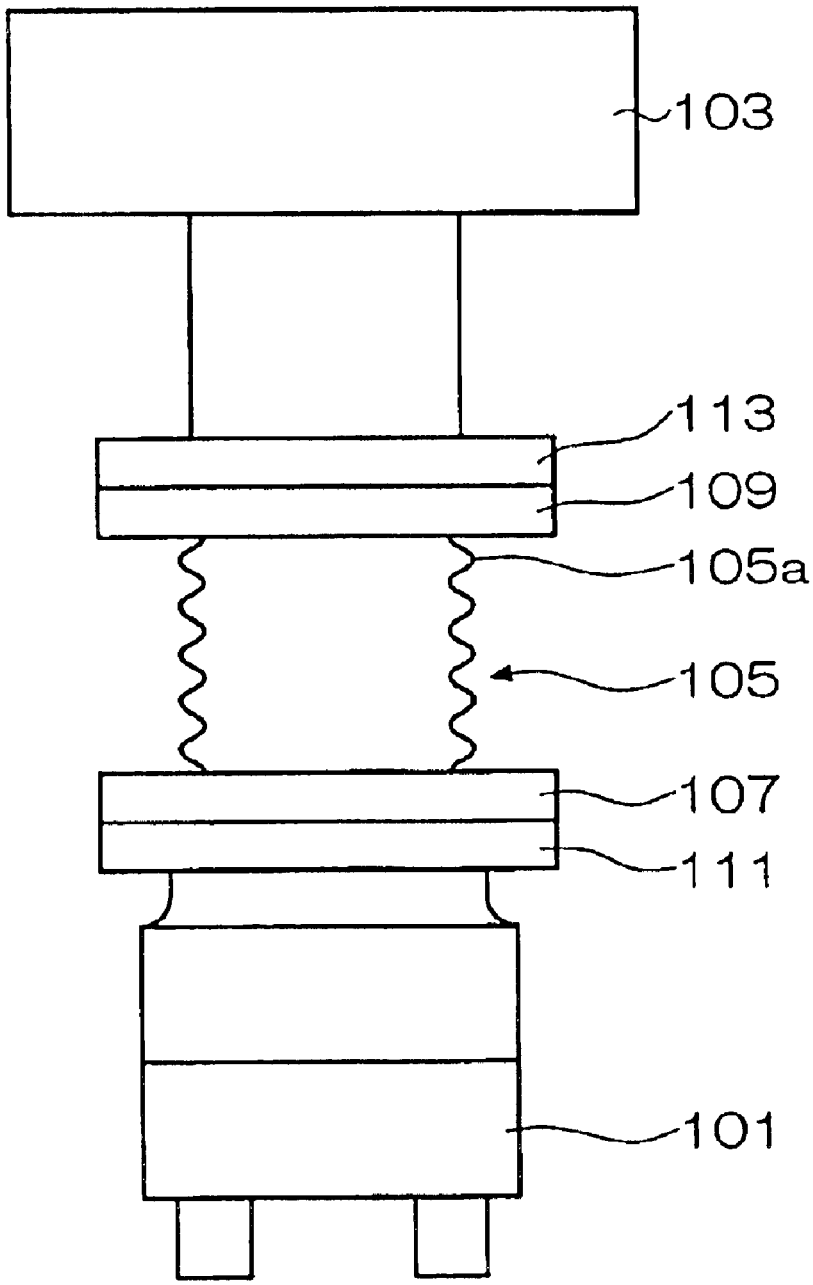
FIG. 6 PRIOR ART
FIG. 6 is a view showing a conventional connecting structure for a vacuum pump.

Embodiments of the present invention will be described hereinbelow. FIG. 1 is a side elevation view of a connecting structure for a vacuum pump in accordance with a first embodiment of the present invention. Note that like reference numerals are given to denote portions that are identical to those of FIG. 6, and an explanation thereof is omitted here.

Referring to FIG. 1, a vacuum pump 101 such as a turbo molecular pump is connected through piping to a vacuum chamber 103 in a hanging fashion, with a damper 1 for absorbing mechanical vibrations and providing electrical insulation being interposedly disposed between a suction port thereof and the vacuum chamber 103 being a measurement chamber.

The damper 1 has flanges 3 and 5 arranged on its both ends, and a bellows 7 capable of absorbing mechanical vibrations is provided between the flanges 3 and 5. In addition to being configured to absorb mechanical vibrations, the bellows 7 is formed as an electrical insulating portion made up of an electrical insulating material such as resin, rubber, and ceramic. A protective cover 9 may be provided around the outer periphery of the bellows 7 if necessary.

The protective cover 9 is formed integrally with one of the both flanges of the damper 1, for example with the lower flange 3 (or the upper flange 5) as depicted in the figure, in such a way as to surround the bellows 7. The protective cover 9 is made from metallic material etc. that have a mechanical strength sufficient to provide protection against scattered fragments of the vacuum pump 101 should it be broken due to centrifugal force. Note that the protective cover 9 may not be provided if the bellows 7 itself has a sufficient mechanical strength.

The vacuum pump 101 is for example a decompression and suction pump such as a turbo molecular pump.

Figure 2:
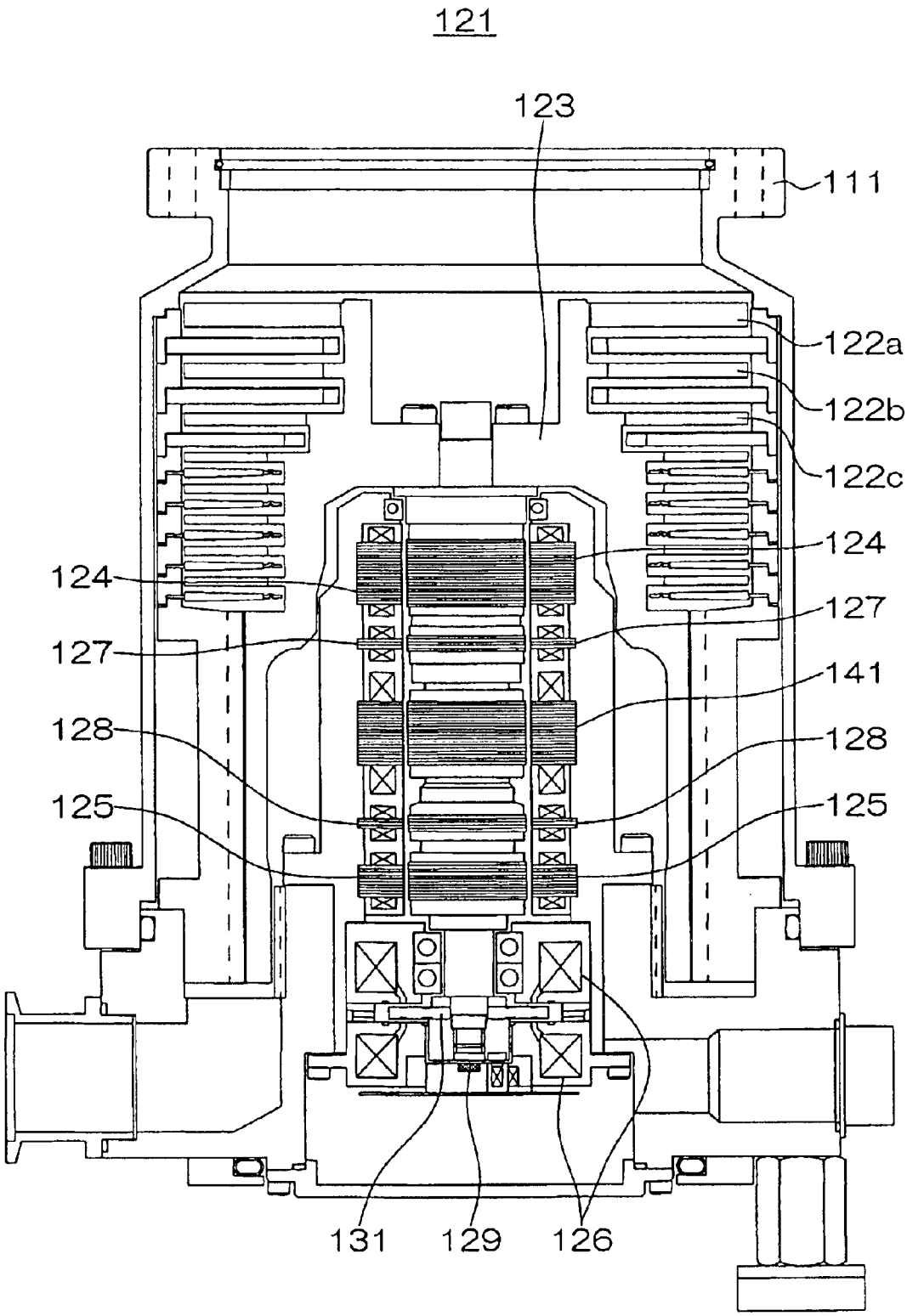
FIG. 2 is a view showing a vertical cross section of a turbo molecular pump.

FIG. 2 shows a vertical cross section of a turbo molecular pump 121.

Referring to FIG. 2, a suction flange 111 is formed at the upper end of the turbo molecular pump 121. Provided further inward therefrom is a rotor 123 having multiple stages of a plurality of rotor blades 122*a*, 122*b*, 122*c* and so on, each being formed of a turbine blade for sucking and discharging gas.

Upper radial electromagnets 124 consist of four electromagnets arranged in pairs with respect to x and y axes. Four inductance-type upper radial sensors 127 are provided proximate to and in association with these upper radial electromagnets 124. Each upper radial sensor 127 is configured to detect a radial displacement of the rotor 123 and sends it to a magnetic bearing controlling unit in a not-shown pump control apparatus.

On the basis of a displacement signal detected by each upper radial sensor 127, the magnetic bearing controlling unit controls magnetic excitation of the upper radial electromagnets 124 through a compensation circuit having a PID control function, thereby regulating a radial position of an upper portion of the rotor 123. Such positional regulation is performed in x-axis as well as y-axis directions.

Likewise, lower radial electromagnets 125 and lower radial sensors 128 are provided in a manner similar to that of the upper radial electromagnets 124 and the upper radial sensors 127 described above, thus regulating a radial position of a lower portion of the rotor 123.

Further, axial electromagnets 126 are arranged so as to oppose each other through a metallic disk 131 provided to the rotor 123. Also, there is provided an axial sensor 129 for detecting an axial displacement of the rotor 123, which is configured to send an axial displacement signal to the magnetic bearing controlling unit.

Magnetic excitation of each axial electromagnet 126 is controlled by the magnetic bearing controlling unit on the basis of the thus obtained axial displacement signal, whereby the rotor 123 is magnetically levitated in its axial direction.

A motor 141 has a plurality of magnetic poles circumferentially arranged so as to encircle the rotor 123. Each magnetic pole is controlled by a motor control unit of the pump control apparatus so as to rotationally drive the rotor 123 through an electromagnetic force acting between the each magnetic pole and the rotor 123.

Next, description will be made of operation of a connecting structure for the vacuum pump 101 in accordance with an embodiment of the present invention.

When the vacuum pump 101 is activated, the vacuum chamber 103 being a measurement chamber is decompressed to vacuum through the connection piping that includes the damper 1. Mechanical vibrations and electrical noise, which the vacuum pump 101 generates at this time, are transmitted to the damper 1 that is connected to the suction flange 111.

At the damper 1, the mechanical vibrations generated by the vacuum pump 101 are received by the bellows 7, whereby the mechanical vibrations are absorbed before reaching the vacuum chamber 103 being a measurement chamber. The damper 1 also blocks out electrical noise generated by the vacuum pump 101 with the bellows 7 having electrical insulating properties.

Therefore, with the connecting structure for the vacuum pump 101 in accordance with the present invention, mechanical vibrations and electrical noise generated by the vacuum pump 101 are effectively blocked out before propagating into an apparatus to which the vacuum pump is connected through piping.

As described above, the damper 1 is adapted primarily to absorb the mechanical vibrations and provide electrical insulation between the suction port of the vacuum pump 101 and the vacuum chamber 103 being a measurement chamber. As such, it is sufficient for the above function to be realized to constitute the electrical insulating portion thereof as being capable of providing electrical insulation between the both flanges 3 and 5. Therefore, the above-described construction of the damper 1 is by no means limitative and the damper 1 may be implemented in a variety of forms.

Figure 3:
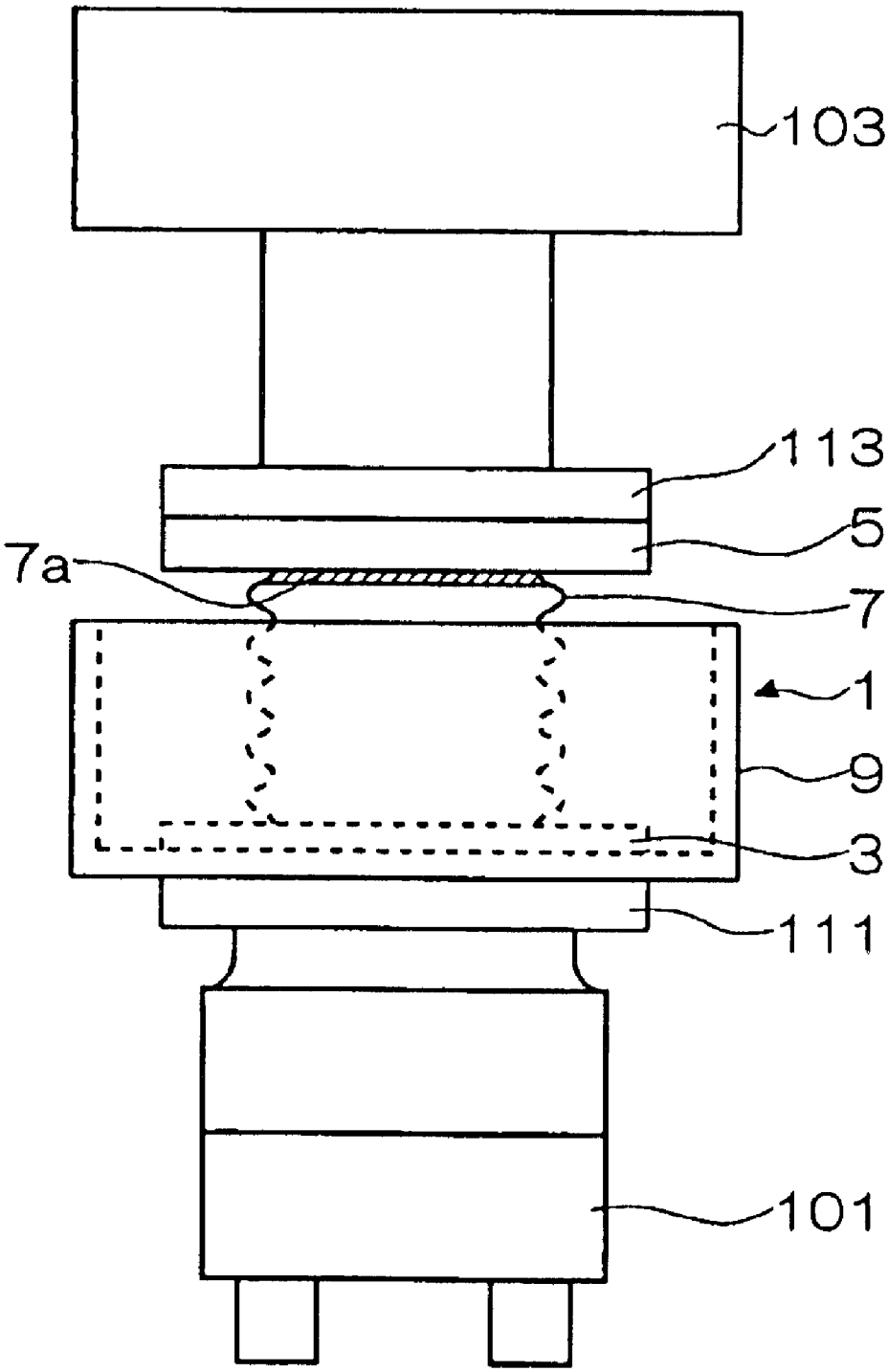
FIG. 3 is a view showing an example in which a part of a bellows is circumferentially formed from an electrical insulating material.
Figure 4:
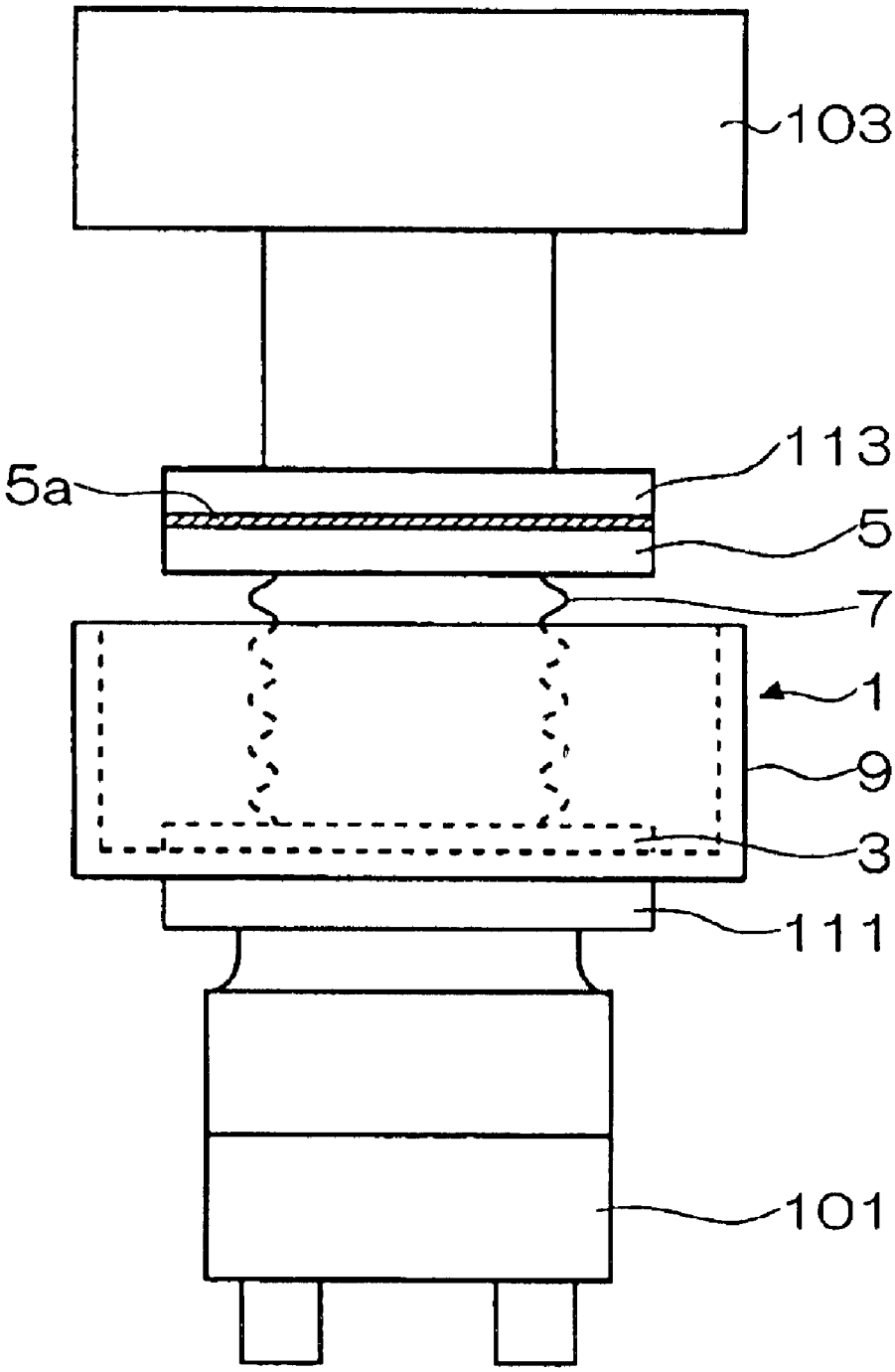
FIG. 4 is a view showing an example in which an electrical insulating portion made up of an insulating coating, an insulating plate, or the like is interposedly provided on a flange surface.

Specifically, as depicted in FIG. 3, a part 7*a* of the bellows 7 may be circumferentially formed from an electrical insulating material, or at least one of the both flanges 3 and 5 may be formed of an electrical insulating material. Alternatively, as shown in FIG. 4, an electrical insulating portion 5*a* consisting of an insulating coating, an insulating plate, or the like may be provided on a surface of one of the both flanges 3 and 5 and fastened thereto with an insulating bolt. When formed of a buffer material such as rubber, the electrical insulating portion can also function to absorb mechanical vibrations, in addition to having electrical insulating properties.

To provide effective protection in an event of the vacuum pump 101 being broken due to centrifugal force, a protective cover 9 may be provided so as to surround the outer periphery of the bellows 7, thus allowing less stringent design conditions to be applied regarding the mechanical strength of the bellows 7. This translates into a wider range of choice in the construction of the bellows 7, including use of a variety of materials such as resin, rubber, ceramic, or the like as its material, thus permitting a greater freedom of its design.

The method for attaching the protective cover 9 may take a variety of forms. The only requirement in this case is to constitute the protective cover 9 so as to surround the outer periphery of the bellows 7 so that it can receive fragments of the vacuum pump 101 which are scattered penetratingly through the bellows 7 when breakage occurs in the vacuum pump 101. Therefore, attachment of the protective cover 9 may be performed by fastening the protective cover 9 that is formed separately from the damper 1, together with one of the both flanges 3 and 5.

Next, description will be made of a second embodiment of the present invention.

Figure 5:
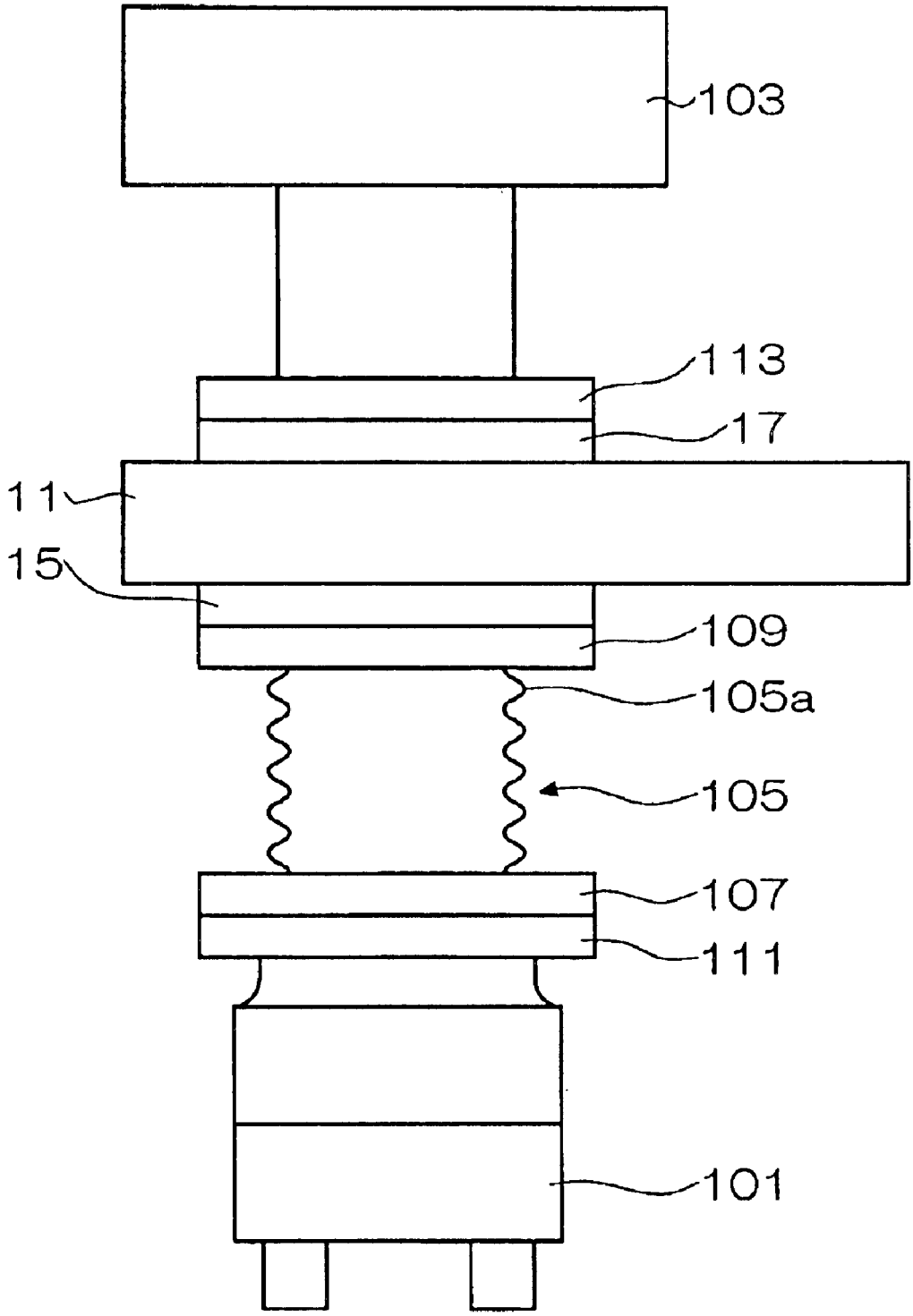
FIG. 5 is a side elevation view of a connecting structure for a vacuum pump in accordance with a second embodiment of the present invention.

FIG. 5 is a side elevation view of a connecting structure for the vacuum pump 101 in accordance with a second embodiment of the present invention. Note that like reference numerals are given to denote portions that are identical to those of FIGS. 1 and 6, and an explanation thereof are omitted here.

Referring to FIG. 5, a damper 105 and a valve 11 are arranged in series through piping connection between a vacuum pump 101 and a vacuum chamber 103 being a measurement chamber. A flange 17 at the upper end of the valve 11 is coupled with a flange 113 of the vacuum chamber 103 being a measurement chamber. Also, a flange 15 at the lower end of the valve 11 is coupled with a flange 109 at the upper end of the damper 105.

The valve 11 is a pressure control valve for controlling a pressure within the vacuum chamber 103 on the measurement chamber side. The valve 11 is constructed such that it constitutes an electrical insulating portion in its entirety, or the electrical insulating portion is interposedly formed between the both flanges 15 and 17.

In the case where the whole of the valve 11 is to be constructed as the electrical insulating portion, its main body casing is formed using an electrical insulating material. As a structural example in which the electrical insulating portion is interposingly provided between the both flanges 15 and 17, at least one of the both flanges 15 and 17 is formed of an electrical insulating material, as in the case of constructing the damper 1 described above.

Alternatively, an electrical insulating portion consisting of an insulating coating, an insulating plate, or the like may be interposedly provided on a surface of one of the both flanges 15 and 17 and fastened thereto with an insulating bolt. In this case, using a buffer material such as rubber for the electrical insulating portion allows the electrical insulating portion to have not only electrical insulating property but also have a mechanical vibration absorbing function as well. The present construction is similar to that for the aforementioned damper 1 also in this respect.

In this way, the electrical insulating portion is interposedly provided within the connection piping between the vacuum pump 101 and the vacuum chamber 103 being a measurement chamber. Therefore, the mechanical vibrations generated by the vacuum pump 101 are absorbed by the damper 105, while the associated electrical noise is blocked out by the electrical insulating portion of the valve 11.

As has been described above, according to the present invention, the electrical insulating portion is interposedly provided within the connection piping extending from the vacuum pump to an apparatus to which the vacuum pump is connected. Therefore, propagation of the electrical noise that is generated by the vacuum pump is effectively blocked by the electrical insulating portion.

Accordingly, even in the case where the vacuum pump is connected to a measuring apparatus which requires for its operation an electromagnetic insulating environment, an electrical insulating environment is ensured, while eliminating an influence of electrical noise or the like generated by the vacuum pump, in addition to ensuring a vibration-free environment by means of the damper.

What is claimed is:

1. In combination: a vacuum chamber; a vacuum pump for evacuating the vacuum chamber; and connecting means comprised of a bellows for connecting the vacuum chamber to a suction flange of the vacuum pump and for absorbing mechanical vibrations generated by the vacuum pump, the bellows being independent from and disposed between the vacuum pump and the vacuum chamber and having at least an electrical insulating portion for providing electrical insulation between the vacuum pump and the vacuum chamber to prevent any electrical current from flowing therebetween, opposite ends, and a pair of flanges each disposed on a respective one of the ends of the bellows, the electrical insulating portion comprising one of an insulating coating and an insulating plate disposed on a surface of one of the flanges of the bellows.

2. A combination according to claim 1; wherein the electrical insulating portion of the bellows is formed of at least one material selected from the group consisting of resin, rubber, and ceramic.

3. A combination according to claim 2; wherein the one of the insulating coating and the insulating plate is formed of an elastic buffer material.

4. A combination according to claim 1; further comprising a protective cover disposed around the bellows for protecting the bellows, the protective cover being connected to one of the flanges of the bellows.

5. A combination according to claim 4; wherein the one of the insulating coating and the insulating plate is formed of an elastic buffer material.

6. A combination according to claim 1; wherein the one of the insulating coating and the insulating plate is formed of an elastic buffer material.

7. In combination: a vacuum chamber; a vacuum pump for evacuating the vacuum chamber; and connecting means comprised of a valve for connecting the vacuum chamber to a suction flange of the vacuum pump and for adjusting a suction flow rate of the vacuum pump, the valve being independent from and disposed between the vacuum pump and the vacuum chamber and having at least an electrical insulating portion for providing electrical insulation between the vacuum pump and the vacuum chamber to prevent any electrical current from flowing therebetween.

8. A combination according to claim 7; wherein the valve has a pair of flanges each connected to a respective one of opposite ends of the valve.

9. A combination according to claim 8; wherein the valve is formed entirely of an electrical insulating material.

10. A combination according to claim 8; wherein the electrical insulating portion comprises one of an insulating coating and an insulating plate disposed on a surface of one of the flanges of the valve.

11. A combination according to claim 10; wherein the one of the insulating coating and the insulating plate is formed of an elastic buffer material.

12. A combination according to claim 7; wherein the electrical insulating portion of the valve is formed of at least one material selected from the group consisting of resin, rubber, and ceramic.

13. A combination according to claim 7; further comprising a protective cover disposed around the valve for protecting the valve.

14. In combination: a vacuum chamber; a vacuum pump for evacuating the vacuum chamber; and a pressure control valve connected between the vacuum pump and the vacuum chamber for controlling a pressure within the vacuum chamber, the pressure control valve being independent from the vacuum pump and the vacuum chamber and having at least an electrical insulating portion for providing electrical insulation between the vacuum pump and the vacuum chamber to prevent any electrical current from flowing therebetween.

15. A combination according to claim 14; wherein the pressure control valve is formed entirely of an electrical insulating material.

16. A combination according to claim 14; further comprising a damper disposed between the vacuum pump and the vacuum chamber for absorbing mechanical vibrations generated by the vacuum pump.

17. A combination according to claim 16; wherein the damper comprises a bellows having first and second opposite ends, a first flange connected to the first end of the bellows, and a second flange connected to the second end of the bellows and connected directly to the suction flange of the vacuum pump.

18. A combination according to claim 17; wherein the pressure control valve has a first flange connected directly to the first flange of the damper and a second flange connected directly to a flange of the vacuum chamber.

* * * * *